US008588650B2

(12) United States Patent
Daloia et al.

(10) Patent No.: US 8,588,650 B2
(45) Date of Patent: Nov. 19, 2013

(54) PHOTORECEPTOR CHARGING AND ERASING SYSTEM

(75) Inventors: Gerald F Daloia, Webster, NY (US); Michael A Doody, Manchester, NY (US)

(73) Assignee: Xerox Corporation, Norwalk, CT (US)

( * ) Notice: Subject to any disclaimer, the term of this patent is extended or adjusted under 35 U.S.C. 154(b) by 357 days.

(21) Appl. No.: 13/160,836

(22) Filed: Jun. 15, 2011

(65) Prior Publication Data

US 2012/0321347 A1 Dec. 20, 2012

(51) Int. Cl.
*G03G 21/00* (2006.01)

(52) U.S. Cl.
USPC ..... 399/128

(58) Field of Classification Search
USPC ..... 399/128, 115, 168, 100, 170, 173
See application file for complete search history.

(56) References Cited

U.S. PATENT DOCUMENTS

| | | | | |
|---|---|---|---|---|
| 3,847,478 | A | 11/1974 | Young | |
| 4,534,641 | A | 8/1985 | Gilliland et al. | |
| 4,626,876 | A * | 12/1986 | Miyagawa et al. | 347/140 |
| 7,398,035 | B2 * | 7/2008 | Zona et al. | 399/168 |
| 7,424,250 | B2 | 9/2008 | Markovics et al. | |
| 8,335,450 | B1 * | 12/2012 | Daloia et al. | 399/96 |
| 8,478,173 | B2 * | 7/2013 | Daloia et al. | 399/311 |
| 8,494,401 | B2 * | 7/2013 | Doody et al. | 399/93 |

* cited by examiner

*Primary Examiner* — Walter L Lindsay, Jr.
*Assistant Examiner* — Rodney Bonnette

(57) ABSTRACT

Two thick film charging devices or a common thick film charge device with two separated obverse conductors, sharing a common power supply are used for photoreceptor charge and erase. The thick film charging devices use a set of AC biased electrodes supported on a dielectric material which also support a counter electrode on an opposite side of the dielectric. A DC offset applied to the counter electrodes is used to set photoreceptor charge level. One DC voltage is used for photoreceptor charge and a zero or near zero DC voltage is used to erase residual charge for the photoreceptor.

20 Claims, 4 Drawing Sheets

PHOTORECEPTOR CHARGING AND ERASING SYSTEM

CROSS-REFERENCE TO RELATED APPLICATIONS

Cross-reference is hereby made to commonly assigned and U.S. application Ser. No. 13/030,220, filed Feb. 18, 2011, now U.S. Pat. 8,478,173,and entitled "Limited Ozone Generator Transfer Device" by Gerald F. Daloia, et al., and U.S. application Ser. No. 13/160,845, filed Jun. 15, 2011 , now U.S. Pat. 8,335,450, and entitled "Method for Externally Heating a Photoreceptor" by Gerald F. Daloia, et al. The disclosures of the heretofore-mentioned applications are incorporated herein by reference in their entirety.

BACKGROUND

1. Field of the Disclosure

The present disclosure relates generally to an electrostatographic printing apparatus, and more particularly, concerns a system and method for charging and erasing the surface of a photoreceptor in such a machine.

2. Description of Related Art

Typically, in an electrostatographic printing process of printers, a photoconductive or photoreceptor member is charged by a charging device to a substantially uniform potential so as to sensitize the surface thereof. The charged portion of the photoreceptor member is exposed to selectively dissipate the charges thereon in the irradiated areas. This records an electrostatic latent image on the photoreceptor member. After the electrostatic latent image is recorded on the photoreceptor member, the latent image is developed by bringing a developer material into contact therewith. Generally, the developer material comprises toner particles adhering triboelectrically to carrier granules. The toner particles are attracted from the carrier granules either to a donor roll or to a latent image on the photoreceptor member. The toner attracted to the donor roll is then deposited on latent electrostatic images on a charge retentive surface, which is usually a photoreceptor. The toner powder image is then transferred from the photoreceptor member to a copy substrate.

In order to fix or fuse the toner material onto a support member permanently by heat, it is necessary to elevate the temperature of the toner material to a point at which constituents of the toner material coalesce and become tacky. This action causes the toner to flow, to some extent, onto fibers or pores of the support members or otherwise upon surfaces thereof. Thereafter, as the toner materials cool, solidification of the toner materials occurs causing the toner material to be bonded firmly to the support member.

Transfer is typically carried out by the creation of a "transfer-detack zone" (often abbreviated to just "transfer zone") of AC and DC biases where the print sheet is in contact with, or otherwise proximate to, the photoreceptor member. A DC bias applied to the back (i.e., on the face away from the photoreceptor member) of the paper or other substrate in the transfer zone electrostatically transfers the toner from the photoreceptor member to the paper or other substrate presented to the transfer zone. The toner particles are heated to permanently affix the powder image to the copy substrate. Biased transfer rolls are also used to transfer an image from a photoreceptor member to media, for example, the segmented bias roll disclosed in U.S. Pat. No. 3,847,478.

An erase device is used to remove any remaining photoreceptor charge in the xerographic process, such as, shown in U.S. Pat. Nos. 4,534,641 and 7,424,250 B2. Known charge/discharge systems utilize different charging devices such as a pin scorotron or dicorotron, and different erase mechanisms such as erase lamps or wires and different AC and DC power supplies. The different components and power supplies required for the charging and erase functions can be quite costly.

Thus, there is still a need for a system and method for performing the charge/erase functions at reduced cost.

BRIEF SUMMARY

In answer to this need, provided hereinafter is a single charge/erase system that employs two thick film charging devices sharing a common power supply for photoreceptor charge and erase. Each thick film charging device uses a set of AC biased electrodes supported on a dielectric material which also supports a counter electrode on the obverse side. A DC offset, applied to the common counter electrode or upper conductor, is used to set the photoreceptor charge level. One DC voltage is used for photoreceptor charge and a zero or near zero DC voltage for photoreceptor erase. The common counter electrodes can be individually biased enabling either a single unified charge device or a pair of devices.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, media, or other useable physical substrate for printing images thereon, whether precut or initially web fed.

As to specific components of the subject apparatus or methods, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1A:
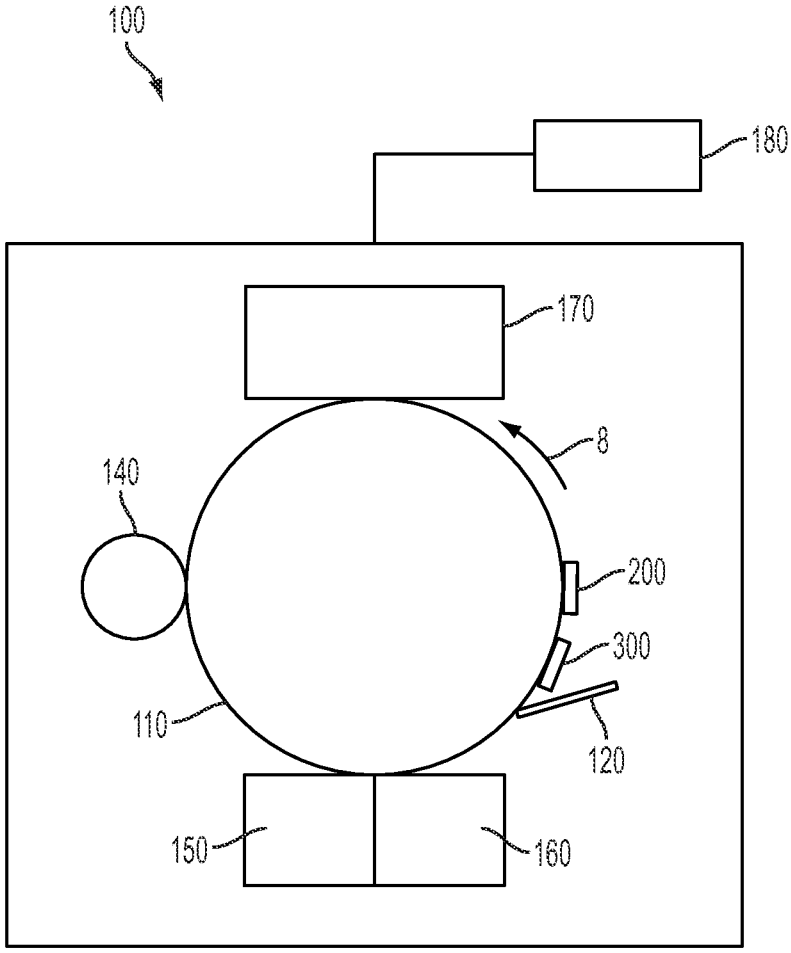
FIG. 1A is a partial, frontal view of an exemplary modular xerographic printer that employs the dual purpose thick film charging/erase device of the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

For a general understanding of the features of the disclosure, reference is made to the drawings. In the drawings, like reference numerals have been used throughout to identify identical elements.

Referring now to FIG. 1A, an electrographic printing system is shown that includes two thick film charging devices configured to charge a photoreceptor surface and to erase the charge from the photoreceptor surface.

In FIG. 1A, a marking device 100 is shown that includes a photoreceptor 110 which advances through processing stations in the direction of arrow 8, a cleaning device 120, a developer 140, a transfer device 150, a detack device 160, a thick film charging device 200, an exposure device 170 and a controller 180. Controller 180 controls a charge being applied to the photoreceptor 110 by thick film charging device 200, then an image-wise pattern of light from exposure device 170 exposes and photo-discharges the photoreceptor 110. Subsequently, charged toner particles are provided to adhere to the discharged areas of the photoreceptor 110, then the controller controls the application of a charge, with a sign opposite to the charge applied to the photoreceptor 110, to the receiving substrate at the transfer device 150 to remove the developed toner while retaining the image-wise pattern, and some additional charge is applied via the detack device 160 to the substrate to facilitate stripping of the substrate from the photoreceptor 110. Residual toner is then cleaned off the photoreceptor 110 by cleaner 120.

Figure 2A:
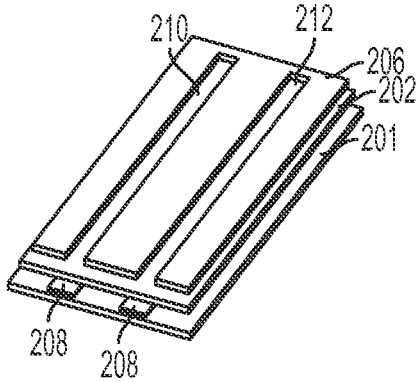
FIG. 2A is perspective view of the dual purpose thick film charging device in accordance with the present disclosure used in the printing apparatus of FIG. 1.
Figure 3:
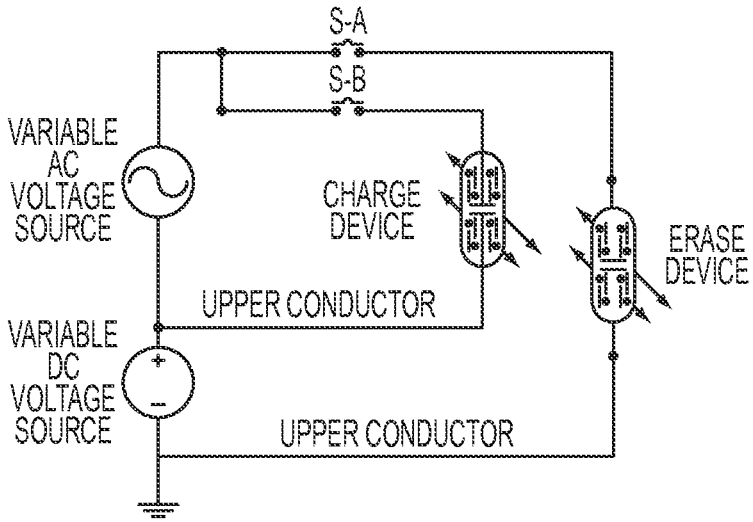
FIG. 3 is an electrical schematic for controlling ion production of the electrodes shown in FIGS. 2A and 2B.
Figure 4:
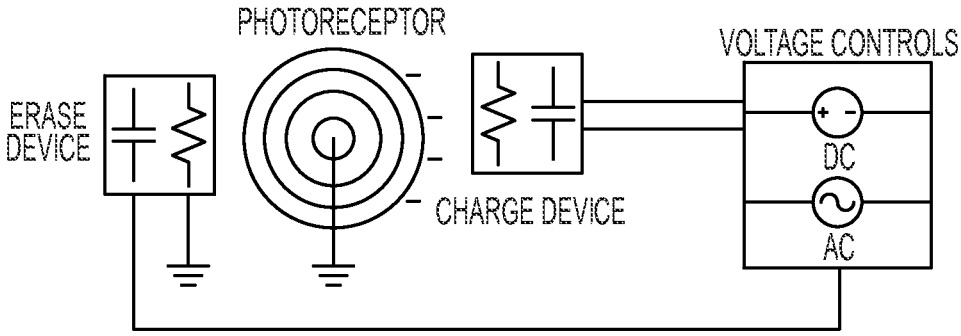
FIG. 4 is a thick film charging device operational depiction.

In accordance with the present disclosure, the thick film charging device 200 is used to charge photoreceptor 110 and thick film charging device 300 is used to erase the charge from the photoreceptor as shown in FIGS. 2A and 3-4. Both thick film charging devices 200 and 300 comprise a ceramic substrate 201 that supports a dielectric layer 202 positioned between two conductive layers 206 and 208. Conductive layer 206 includes slots 210 and 212 therein while conductor 208 is in the form of two conductive strips with the two conductive strips underlying the slots 210 and 212 of the upper electrode. Corona generation is created within the slots 210 and 212. Energizing conductive layers 206 and 208 charges the surface of the photoreceptor to a relatively high, substantially uniform potential.

The electrical schematic in FIG. 3 depicts the two thick film charging devices 200 and 300 in a one line operational mode. Each line has one electrode (lower conductor) and all electrodes have a common upper conductor (FIG. 2A). The number of electrodes is dependent upon the charging device application and the ceramic substrate's physical dimensions and the amount of power needed for the application.

The charging device's selected materials allow for the thick film circuit to handle AC voltages as high as 3000 volts pk-pk and DC voltages up to 1100 volts. The ceramic's rigidity permits the device to be suspended adjacent photoreceptor 110, while being supported at its ends.

Switch S-A controls the AC high voltage delivered to the first thick film charger used as the photoreceptor erase device while switch S-B delivers the AC high voltage to the $2^{nd}$ thick film charger used as the photoreceptor charge device. Operation of the charging device requires the AC voltage to be greater than 1800 volts pk-pk in order to strike corona. The upper conductors are connected to a variable DC voltage supply or to ground.

Corona generation occurs when the electrodes are subjected to the AC high voltage. The electrical fields that surround the electrodes cause the air molecules to ionize on the surface of the dielectric between the upper conductor fingers in slots 210 and 212 (FIG. 2A). The upper conductor may be further energized to a DC voltage which establishes and controls the charge on photoreceptor surface. The charge device 200 (FIG. 1A) generates a plasma field which enables the DC charge to flow from the top conductive layer onto the photoreceptor surface.

By applying suitable AC and DC voltages to the conductors of the thick film charge device 200 (FIG. 2A), a corona and a voltage potential are produced on the upper conductor and then to the photoreceptor as shown in the single charge/erase system operational depiction in (FIG. 3). Utilizing the same power supply system and applying the AC voltage to the erase device 300 (FIG. 1A), while applying zero DC potential on the upper conductor; a corona on the surface of the thick film device will be produced. The erase device exposes the surface of photoreceptor 110 to a zero potential; thereby removing any polarity residual charge from the photoreceptor surface. Both the charge device and erase device can be activated together or separately as the system demands using the same single power supply system.

Figure 1B:
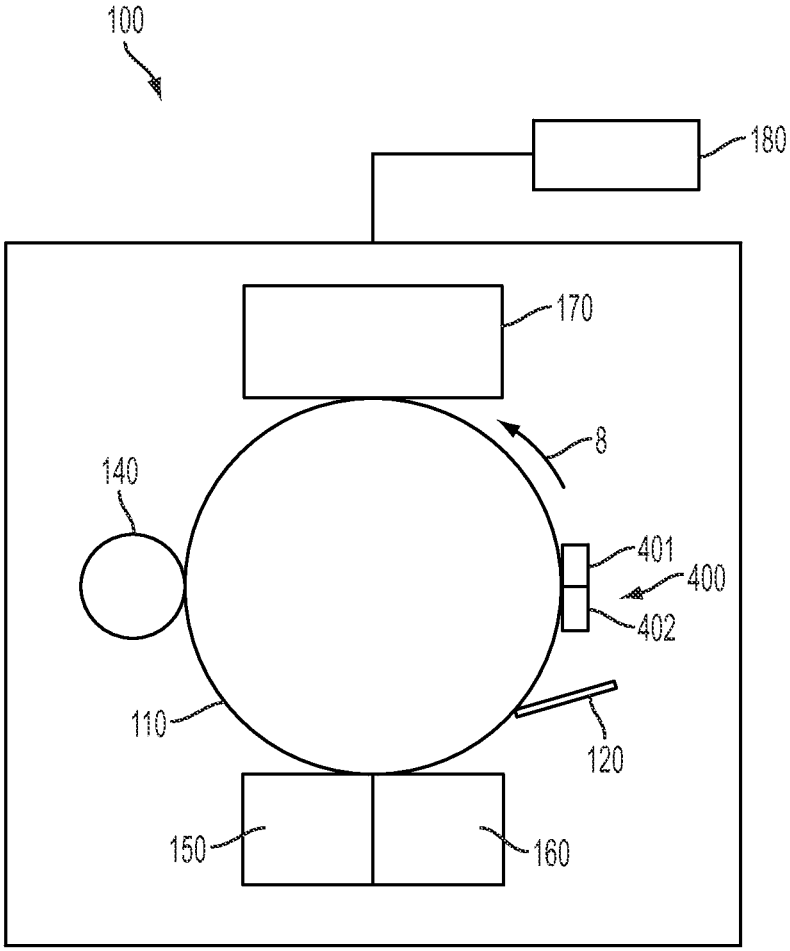
FIG. 1B is a partial, frontal view an exemplary modular xerographic printer that employs a dual purpose thick film charging/erase device in a second embodiment of the present disclosure.
Figure 2B:
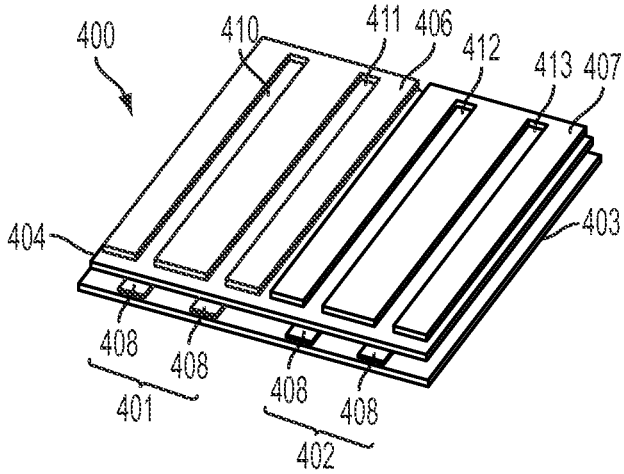
FIG. 2B is perspective view of the dual purpose thick film charging device in accordance with the present disclosure used in the printing apparatus of FIG. 1B.

Alternatively, as disclosed in FIGS. 1B and 2B, a single dual purpose charge/erase thick film device 400 powered by a single power source can be used to both charge and erase photoreceptor surface 110. Thick film charging device 400, as shown in FIG. 1B, includes units 401 and 402 with each unit comprising, as shown in FIG. 2B, a common ceramic substrate 403 that supports a common dielectric layer 404 positioned between separate upper conductive layers 406 and 407 and lower conductive layer 408. Conductive layers 406 and 407 include slots 410 through 413 therein while conductor 408 is in the form of conductive strips with the conductive strips underlying the slots 410 through 413 of the upper conductive layers 406 and 407. Corona generation is created within the slots of upper conductive layers 406 and 407, respectively. Energizing the conductive layers 408 by applying AC voltages as high as 3000 volts pk-pk and energizing the conductive layer 406 by applying DC voltages up to 1100 volts, charges the surface of the photoreceptor to a relatively high, substantially uniform potential. Then separately and simultaneously energizing conductive layers 408 by applying the same AC voltage and by applying zero volts DC on conductive layer 407 erases the surface of the photoreceptor. A single power source is used to energize both units 401 and 402.

In recapitulation, the single charge-erase system of the present disclosure includes a thick film mechanism composed of dielectric layer and conductive layers (FIG. 2A). The charge device can be activated in two configurations. The first applies AC and DC high voltages to the inputs and the device outputs a DC charge that flows to the photoreceptor. The second applies an AC high voltage and a zero DC voltage to the inputs and the device outputs an AC zero potential DC charge which eliminates any residual DC charge on the photoreceptor. Using two thick film charging devices and connecting them to a common power supply results is a single system with one supply and common parts. Alternatively, a single thick film charge device with a separated upper conductor powered by a single power source can be used to both charge and erase a charge retentive surface of a substrate, if desired.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A system for applying a charge and erasing the charge from a photoreceptor, comprising:

photoreceptor surface;

a first charging device including a dielectric and multiple conductive layers;

a second charging device including a dielectric layer and multiple conductive layers;

a single power source connected to said multiple conductive layers of said first and second charging devices; and wherein said charging devices are adapted such that when energized by said power source said first charging device applies both AC and DC voltages to said multiple conductive layers to charge said photoreceptor and said second charging device applies AC voltage to said conductive layers with said second charging device outputting a zero potential charge which erases any residual DC charge on said photoreceptor.

2. The system of claim 1, wherein each of said first and second charging devices include a dielectric support member, said dielectric member supporting an AC biased conductive layer on a surface thereof.

3. The system of claim 2, wherein said AC biased conductive layer is a lower conductive layer.

4. The system of claim 2, wherein said dielectric support member supports a counter conductive layer on an obverse side thereof.

5. The system of claim 4, wherein a DC offset is applied to said conductive layers of said first charging device in order to set a predetermined charge level on said photoreceptor surface.

6. The system of claim 5, wherein a DC voltage is used said first charging device for charging said photoreceptor surface and an approximately zero DC voltage is used in said second charging device to erase said photoreceptor surface.

7. The system of claim 5, wherein said conductive layers of said first and second charging devices are individually biased.

8. The system of claim 1, wherein each of said first and second charging devices include a ceramic substrate support member.

9. The system of claim 1, wherein said conductive layers of said first and second charging devices are biased to enable a single unified charge device.

10. The system of claim 1, including a first switch to control AC voltage delivered to said first charging device and a second switch to control AC voltage to said second charging device.

11. The system of claim 10, wherein said AC voltage is at least 1800 volts pk-pk.

12. The system of claim 1, wherein said multiple conductive layers of said first and second charging devices includes at least two conductive layers.

13. A system for applying charge and erasing charge from a charge retentive substrate, comprising:

a charge retentive surface;

a charging device that includes a dielectric layer and conductive layers;

a single power source connected to said conductive layers of said charging device; and wherein said charging device is configured such that when energized by said power source a first portion of said charging device applies both AC and DC voltages to said conductive layers to charge said charge retentive surface and a second portion of said charging device applies the same AC voltage and zero DC voltage to said conductive layers of said second portion of said charging device outputting a zero potential charge which erases any residual DC charge on said charge retentive surface.

14. The system of claim 13, wherein said charging device includes a dielectric support member, said dielectric support member supporting an AC biased conductive layer on a surface thereof.

15. The system of claim 14, wherein said dielectric support member supports a counter conductive layer on an obverse side thereof.

16. A method for applying a charge and erasing the charge from a photoreceptor, comprising:

providing a photoreceptor surface;

providing multiple charging devices with each charging device including a dielectric layer and multiple conductive layers;

providing a single power source connected to said multiple conductive layers of said multiple charging devices; and configuring said multiple charging devices such that when energized by said power source said multiple charging devices simultaneously applies both AC and DC voltages to said multiple conductive layers of at least one said charging device to charge said photoreceptor and applies an AC voltage and zero DC voltage to said conductive layers of at least one said charging device which erases any residual DC charge on said photoreceptor.

17. The method of claim 16, including providing each of said charging devices with a dielectric support member, said dielectric member supporting an AC biased conductive layer on a surface thereof.

18. The method of claim 17, wherein said dielectric support member supports a counter conductive layer on an obverse side thereof.

19. The method of claim 18, wherein a DC offset is applied to said conductive layers in order to set a predetermined charge level on said photoreceptor surface.

20. The method of claim 19, wherein said conductive layers are individually biased.

* * * * *